US009279300B2

(12) United States Patent
Kolle et al.

(10) Patent No.: US 9,279,300 B2
(45) Date of Patent: Mar. 8, 2016

(54) SPLIT RING SHIFT CONTROL FOR HYDRAULIC PULSE VALVE

(71) Applicant: Tempress Technologies, Inc., Kent, WA (US)

(72) Inventors: Jack J. Kolle, Seattle, WA (US); Kenneth J. Theimer, Auburn, WA (US)

(73) Assignee: Tempress Technologies, Inc., Renton, WA (US)

( * ) Notice: Subject to any disclaimer, the term of this patent is extended or adjusted under 35 U.S.C. 154(b) by 524 days.

(21) Appl. No.: 13/727,482

(22) Filed: Dec. 26, 2012

(65) Prior Publication Data

US 2013/0112427 A1 May 9, 2013

Related U.S. Application Data

(63) Continuation-in-part of application No. 12/957,049, filed on Nov. 30, 2010, now Pat. No. 8,528,649.

(60) Provisional application No. 61/581,017, filed on Dec. 28, 2011.

(51) Int. Cl.

| | |
|---|---|
| ***E21B 34/06*** | (2006.01) |
| ***E21B 28/00*** | (2006.01) |
| ***E21B 21/10*** | (2006.01) |
| ***E21B 47/18*** | (2012.01) |

(Continued)

(52) U.S. Cl.

CPC ..... *E21B 21/10* (2013.01); *E21B 34/06* (2013.01); *E21B 37/00* (2013.01); *E21B 43/25* (2013.01); *E21B 47/18* (2013.01)

(58) Field of Classification Search

CPC ..... E21B 34/08; E21B 14/014; E21B 21/10; E21B 21/103; E21B 1/00; E21B 10/36; E21B 4/014; E21B 34/10; E21B 28/00; E21B 31/13; E21B 47/18; E21B 34/06

USPC ..... 166/373; 137/826, 830; 175/57

See application file for complete search history.

(56) References Cited

U.S. PATENT DOCUMENTS

| | | | |
|---|---|---|---|
| 699,273 | A | 5/1902 | Wolski |
| 1,963,090 | A | 6/1934 | Jakosky |
| 2,342,732 | A | 2/1944 | Gudmundsen |

(Continued)

FOREIGN PATENT DOCUMENTS

| | | |
|---|---|---|
| DE | 1568680 | 6/1980 |
| SU | 587240 | 10/1972 |

OTHER PUBLICATIONS

Borland et al., "Drill Bit Seismic, Vertical Seismic Profiling, and Seismic Depth Imaging to Aid Drilling Decisions in the Tho Tinh Structure Nam Con Son Basin—Vietnam," Butsuri-Tansa vol. 51, No. 1: 27-44, 1998.

(Continued)

*Primary Examiner* — Blake Michener
*Assistant Examiner* — Michael Wills, III
(74) *Attorney, Agent, or Firm* — Morgan, Lewis & Bockius LLP

(57) ABSTRACT

A hydraulic pulse valve for use in downhole tools includes a split ring seal to limit the fluid flow available to shift a poppet in the valve from an open position to a closed position. The split ring seal provides relatively long and repeatable pressure pulses, which improve the effectiveness of the hydraulic pulse valve for borehole applications.

20 Claims, 4 Drawing Sheets

(51) Int. Cl.
*E21B 37/00* (2006.01)
*E21B 43/25* (2006.01)

(56) References Cited

U.S. PATENT DOCUMENTS

| | | | |
|---|---|---|---|
| 2,359,629 | A | 10/1944 | Dexter et al. |
| 2,388,741 | A | 11/1945 | Hays |
| 2,421,769 | A | 6/1947 | Wolfe |
| 2,445,803 | A | 7/1948 | Rogers |
| 2,492,605 | A | 12/1949 | Varney et al. |
| 2,535,079 | A | 12/1950 | Lebert |
| 2,543,063 | A | 2/1951 | Rodgers |
| 2,562,721 | A | 7/1951 | Jakosky |
| 2,562,724 | A | 7/1951 | Lebert |
| 2,743,083 | A | 4/1956 | Zublin |
| 2,855,671 | A | 10/1958 | Lundgren et al. |
| 2,902,258 | A | 9/1959 | Hildebrandt |
| 2,963,099 | A | 12/1960 | Gianelloni, Jr. |
| 3,054,595 | A | 9/1962 | Kaufmann |
| 3,058,510 | A | 10/1962 | Tiraspolsky et al. |
| 3,065,805 | A | 11/1962 | Martini |
| 3,433,489 | A | 3/1969 | Wiese |
| 3,441,094 | A | 4/1969 | Galle et al. |
| 3,520,225 | A | 7/1970 | Baugh |
| 3,568,783 | A | 3/1971 | Chenoweth et al. |
| 3,606,410 | A | 9/1971 | Inserra |
| 3,648,786 | A | 3/1972 | Chenoweth |
| 3,648,789 | A | 3/1972 | Eriksson |
| 3,655,424 | A | 4/1972 | Orowan |
| 3,728,040 | A | 4/1973 | Ioanesian et al. |
| 3,802,515 | A | 4/1974 | Flamand et al. |
| 3,810,637 | A | 5/1974 | Bonvin |
| 4,033,429 | A | 7/1977 | Farr |
| 4,114,703 | A | 9/1978 | Matson, Jr. et al. |
| 4,190,202 | A | 2/1980 | Yie |
| 4,196,911 | A | 4/1980 | Matsushita |
| 4,213,332 | A | 7/1980 | Bonomo et al. |
| 4,225,000 | A | 9/1980 | Maurer |
| 4,246,976 | A | 1/1981 | McDonald, Jr. |
| 4,324,299 | A | 4/1982 | Nagel |
| 4,418,721 | A | 12/1983 | Holmes |
| 4,437,525 | A | 3/1984 | O'Hanlon et al. |
| 4,440,242 | A | 4/1984 | Schmidt et al. |
| 4,454,935 | A | 6/1984 | Pryor |
| 4,493,381 | A | 1/1985 | Kajikawa et al. |
| 4,521,167 | A | 6/1985 | Cavalleri et al. |
| 4,529,046 | A | 7/1985 | Schmidt et al. |
| 4,573,637 | A | 3/1986 | Pater et al. |
| 4,665,997 | A | 5/1987 | Maurer et al. |
| 4,715,538 | A | 12/1987 | Lingnau |
| 4,747,544 | A | 5/1988 | Kranzle |
| 4,762,277 | A | 8/1988 | Pater et al. |
| 4,790,393 | A | 12/1988 | Larronde et al. |
| 4,817,739 | A | 4/1989 | Jeter |
| 4,819,745 | A | 4/1989 | Walter |
| 4,821,961 | A | 4/1989 | Shook |
| 4,830,122 | A | 5/1989 | Walter |
| 4,862,043 | A | 8/1989 | Zieve |
| 4,863,101 | A | 9/1989 | Pater et al. |
| 4,887,643 | A | 12/1989 | Tomlin et al. |
| 4,890,682 | A | 1/1990 | Worrall et al. |
| 4,905,775 | A | 3/1990 | Warren et al. |
| 4,923,120 | A | 5/1990 | Hammelmann |
| 4,925,510 | A | 5/1990 | Hojo et al. |
| 4,928,509 | A | 5/1990 | Nakamura |
| 4,934,254 | A | 6/1990 | Clark et al. |
| 4,979,577 | A | 12/1990 | Walter |
| 4,997,159 | A | 3/1991 | Yoshino et al. |
| 5,000,516 | A | 3/1991 | Kolle et al. |
| 5,009,272 | A | 4/1991 | Walter |
| 5,028,004 | A | 7/1991 | Hammelmann |
| 5,051,020 | A | 9/1991 | Schleicher |
| 5,121,537 | A | 6/1992 | Matsui et al. |
| 5,190,114 | A | 3/1993 | Walter |
| 5,191,557 | A | 3/1993 | Rector et al. |
| 5,222,425 | A | 6/1993 | Davies |
| 5,279,262 | A | 1/1994 | Muehleck |
| 5,382,760 | A | 1/1995 | Staron et al. |
| 5,396,965 | A | 3/1995 | Hall et al. |
| 5,586,084 | A | 12/1996 | Barron et al. |
| 5,603,385 | A | 2/1997 | Colebrook |
| 5,685,487 | A | 11/1997 | Ellis |
| 5,703,421 | A | 12/1997 | Durkin |
| 5,740,127 | A | 4/1998 | Van Steenwyk et al. |
| 5,803,188 | A | 9/1998 | McInnes |
| 5,909,848 | A | 6/1999 | Zink |
| 5,909,879 | A | 6/1999 | Simpson |
| 5,938,206 | A | 8/1999 | Klosterman et al. |
| 5,950,736 | A | 9/1999 | Goldstein |
| 5,953,809 | A | 9/1999 | Kowalski |
| 6,027,040 | A | 2/2000 | Frye-Hammelmann |
| 6,053,261 | A | 4/2000 | Walter |
| 6,062,311 | A | 5/2000 | Johnson et al. |
| 6,094,401 | A | 7/2000 | Masak et al. |
| 6,191,511 | B1 | 2/2001 | Zysset |
| 6,237,701 | B1 | 5/2001 | Kolle et al. |
| 6,263,969 | B1 | 7/2001 | Stoesz et al. |
| 6,301,766 | B1 | 10/2001 | Kolle |
| 6,347,675 | B1 | 2/2002 | Kolle |
| 6,394,221 | B2 | 5/2002 | Cosma |
| 6,453,996 | B1 | 9/2002 | Carmichael et al. |
| 6,557,856 | B1 | 5/2003 | Azibert et al. |
| 6,774,519 | B2 | 8/2004 | Pullen et al. |
| 6,952,068 | B2 | 10/2005 | Gieras et al. |
| 6,964,270 | B2 | 11/2005 | Janssen et al. |
| 7,139,219 | B2 | 11/2006 | Kolle et al. |
| 7,198,456 | B2 | 4/2007 | Kolle et al. |
| 7,201,238 | B2 | 4/2007 | Marvin et al. |
| 7,310,580 | B2 | 12/2007 | Zhou et al. |
| 7,524,160 | B2 | 4/2009 | Kolle et al. |
| 2001/0030486 | A1 | 10/2001 | Pijanowski |
| 2004/0069530 | A1 | 4/2004 | Prain et al. |
| 2005/0178558 | A1 | 8/2005 | Kolle et al. |
| 2008/0267011 | A1 | 10/2008 | Pratt et al. |
| 2012/0132289 | A1* | 5/2012 | Kolle ..... 137/14 |
| 2013/0000917 | A1* | 1/2013 | Slack et al. ..... 166/321 |

OTHER PUBLICATIONS

Kolle, Jack K., "A Comparison of Water Jet, Abrasive Jet and Rotary Diamond Drilling in Hard Rock," Presentation for Energy Sources Technology Conference & Exhibition (ETCE '98), Houston, TX: 6pp., Feb. 2-4, 1998.

Kolle, Jack K., "Moving an Ice Mountain," Mechanical Engineering: 49-53, Feb. 1990.

Park, Choon Byong; Miller, Richard D.; Steeples, Don W.; and Black, Ross A. "Swept impact seismic techniques (SIST)," Geophysics. vol. 61. No. 6 (Nov.-Dec. 1996): p. 1789-1803. 13 FIGs.

Rector et al., "The use of drill-bit energy as a downhole seismic source," Geophysics vol. 56. No. 5:628-634, May 1991.

Patent Cooperation Treaty, Notification of Transmittal of the International Search Report and the Written Opinion of the International Searching Authority, or the Declaration, Apr. 22, 2013, 2 pages; International Search Report, 3 pages; and Written Opinion of the International Searching Authority, 4 pages.

* cited by examiner

SECTION A-A

SPLIT RING SHIFT CONTROL FOR HYDRAULIC PULSE VALVE

RELATED APPLICATIONS

This application is based on a prior copending provisional application, Ser. No. 61/581,017, filed on Dec. 28, 2011, the benefit of the filing date of which is hereby claimed under 35 U.S.C. §119(e), and is a continuation-in-part of a prior copending application, Ser. No. 12/957,049, filed Nov. 30, 2010, the benefit of the filing date of which is hereby claimed under 35 U.S.C. §120.

BACKGROUND

Fluid is commonly pumped though tubing inserted into a well to drill or to provide intervention services, such as stimulation or milling of obstructions. Means for pulsing this flow of fluid have been developed for a variety of applications, including mud pulse telemetry, well stimulation, enhanced drilling, and to extend the lateral range of drilling motors or other well intervention tools. For example, commonly assigned U.S. Pat. No. 6,237,701 and U.S. Pat. No. 7,139,219 disclose hydraulic impulse generators incorporating self-piloted poppet valves designed to periodically at least partially interrupt the flow of fluid at the bottom end of the tubing. At least partially interrupting the flow of fluid in this manner leads to an increase in pressure upstream of the valve and a decrease in pressure downstream of the valve.

Pressure pulsations in the tubing upstream of the bottom-hole assembly (BHA) have a variety of beneficial effects. The pulsations can improve the performance of rotary drilling by applying a cyclical mechanical load on the bit and cyclic pressure load on the material being cut. In combination, these loads can enhance cutting. In addition, the pulsating vibrations induced by these tools in the tubing can reduce the friction required to feed the tubing into long deviated wells.

The valve also generates pressure fluctuations or pulses in the wellbore near the tool. These pressure pulses can enhance chemical placement in the formation and enhance the production of formation fluids such as oil or gas. In addition, these pulses can be employed to generate a signal that can be used for seismic processing.

The valve designs disclosed in U.S. Pat. Nos. 6,237,701 and 7,139,219 generate a relatively short pressure pulse, which limits both pulse energy and the effectiveness of the pressure pulse. Commonly assigned U.S. patent application Ser. No. 12/957,049 describes an improved apparatus that limits the pressure differential causing the valve to shift from the open to the closed position and incorporates flow restrictions that further limit the shift rate of the valve between the open and closed positions. The apparatus incorporates a spool valve with clearance seals between sliding valve parts. These clearance seals are wear areas, so that the clearance area at the seals may vary during the time that the valve is in service. When the valve is closed, a critical clearance seal area is subject to high differential pressure. Leakage across this clearance seal gap increases the shift speed and reduces the time that the valve stays closed. Close control of this timing is critical for effective operation of the valve. The clearance tolerance range required for acceptable operation is small, and there can be substantial variations in valve performance if the tolerance range is not met. Increased clearance causing increased fluid leakage through the seals is associated with reduced pulse amplitude and duration. Accordingly, it would be desirable to develop a seal that limits leakage in this area of the valve and provides longer pulses, resulting in more uniform pressure profiles.

Further, it would be desirable to increase the amplitude and duration of pulses produced by a hydraulic pulse valve. It would also be desirable to reduce the variability in the pulse profile caused by clearance variations and wear and to provide a reliable, debris-resistant means for adjusting the timing of the valve, i.e., the time required for the valve to move between the open and closed states.

SUMMARY

This application specifically incorporates herein by reference the disclosures and drawings of each patent application and issued patent identified above or referenced as a related application.

In consideration of the discussion provided above, an exemplary hydraulic pulse valve has been developed for generating pressure pulses in a conduit in which the hydraulic pulse valve is disposed. The hydraulic pulse valve includes an elongate housing in which is disposed a valve assembly. The valve assembly includes a poppet that is reciprocally movable between a closed position in which it at least partially blocks a pressurized fluid from flowing through a throat of a poppet seat in the valve assembly, and an open position in which the pressurized fluid flows through the throat of the poppet seat. A reciprocating motion of the poppet between the closed position and the open position generates the pressure pulses in the conduit. Also included in the valve assembly is a pilot that is disposed within the poppet and reciprocates between disparate first and second positions to periodically alter fluid communication paths within the valve assembly. Alteration of the fluid communication paths causes the poppet to reciprocate between the closed position and the open position. A sliding seal in the hydraulic pulse valve controls leakage of a pressurized fluid through the valve assembly, preventing the pilot from prematurely shifting between the first position and the second position. Such premature shifting would cause the poppet to move to the open position too quickly, and the sliding seal thereby increases a time during which the poppet remains in the closed position.

The sliding seal includes a split ring that is actuated by a pressure differential between an inner surface and an outer surface of the split ring. The pressure differential produces a biasing force that causes the inner surface of the split ring to seal around an outer surface of a piston included within the poppet to limit pressurized fluid leakage along the outer surface of the piston where the seal is provided by the split ring. The split ring limits leakage of the pressurized fluid into a cavity defined at least in part by the pilot. As the pilot moves between the first and second positions relative to the split ring, the cavity moves past the split ring, and the split ring then no longer limits leakage of the pressurized fluid into the cavity.

The valve assembly further includes a spool housing in which the poppet and the pilot are disposed. The spool housing can comprise a stack of components that are clamped together.

A flow restriction can be provided that comprises a flat recess on a first component disposed adjacent to a flat surface on a second component. The flat recess and the flat surface together define a slit. The slit intersects a flow passage disposed within the valve assembly and limits a rate at which the pressurized fluid flows through the valve assembly to actuate the pilot to shift between the first and second positions. An opening defined by the slit is smaller in dimension than a diameter of the flow passage intersected by the slit, so that particulate matter that is small enough to pass through the slit will not plug the flow passage to prevent the pressurized fluid from flowing through the flow passage. The slit can be formed between a stop ring and a sleeve disposed around the piston.

The flow passage intersected by the slit can be employed to convey the pressurized fluid to a cavity in which the sliding seal is disposed. In some exemplary embodiments, the slit can be defined in part by a surface of a lower stop ring. In this embodiment, the slit can filter particulates from the pressurized fluid used to actuate the pilot.

Another aspect of this technology is directed to an exemplary method for generating pressure pulses in a conduit. This method comprises a procedure that is generally consistent with the functions carried out by the components of the hydraulic pulse valve discussed above.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

Figure 2C:
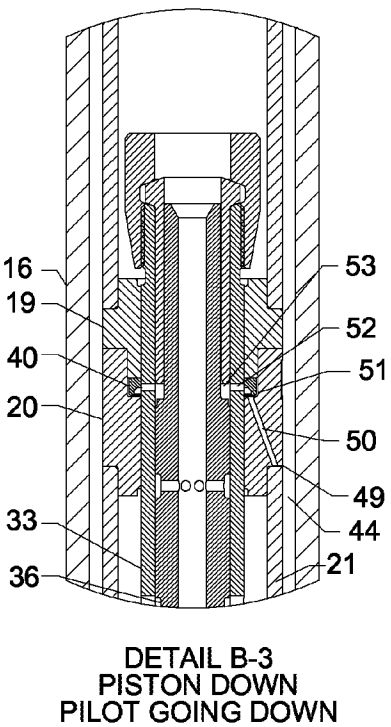
Figure 2B:
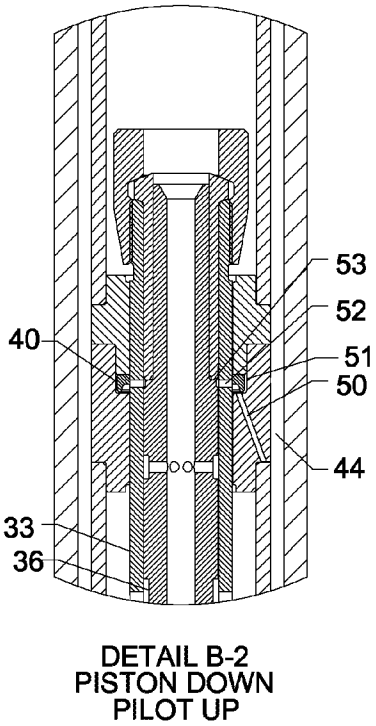
Figure 2A:
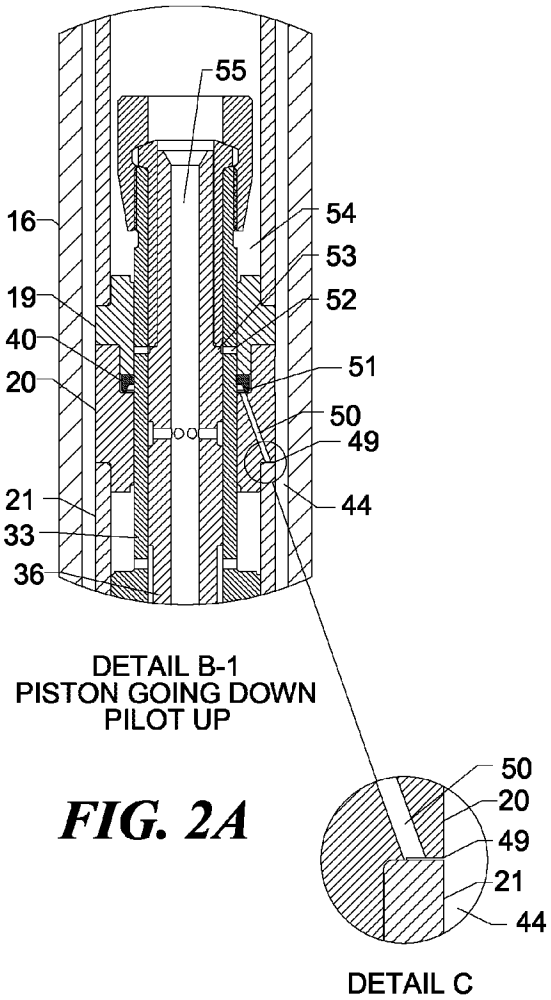
Figure 3:
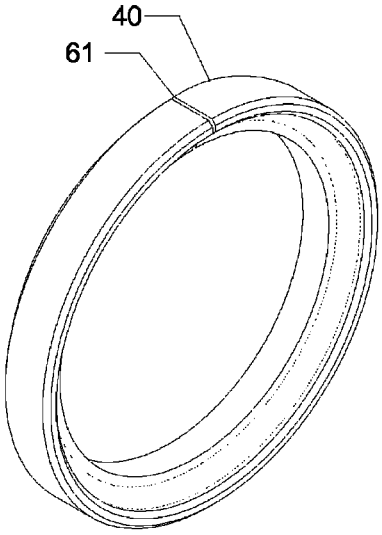
Figure 4:
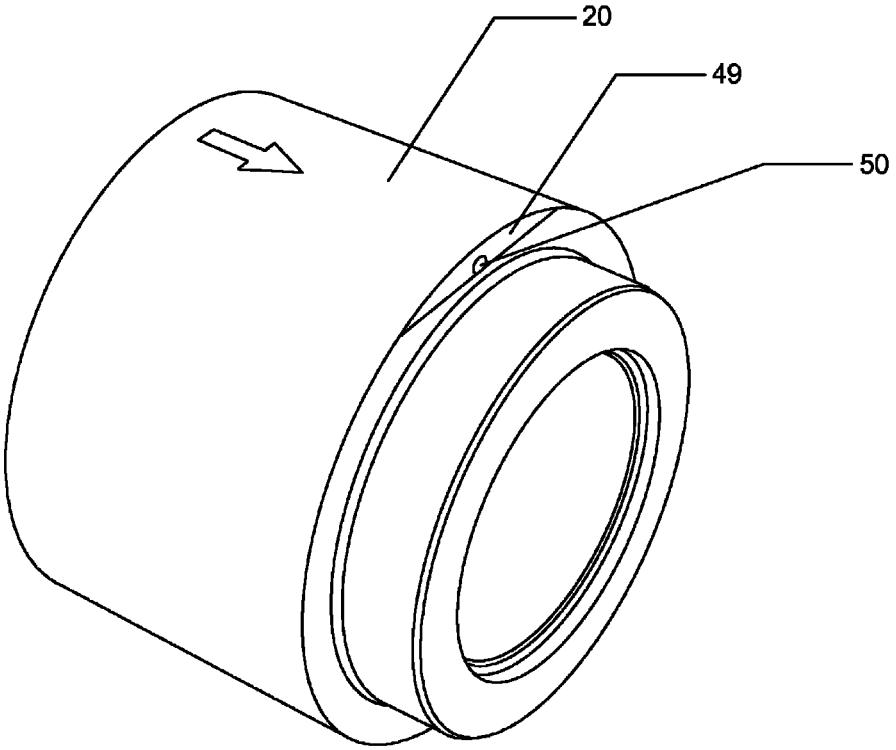
Figure 5A:
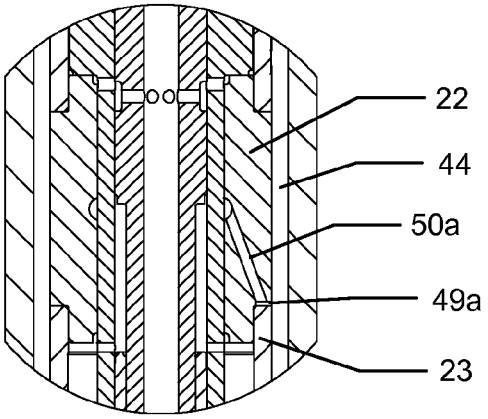
Figure 5B:
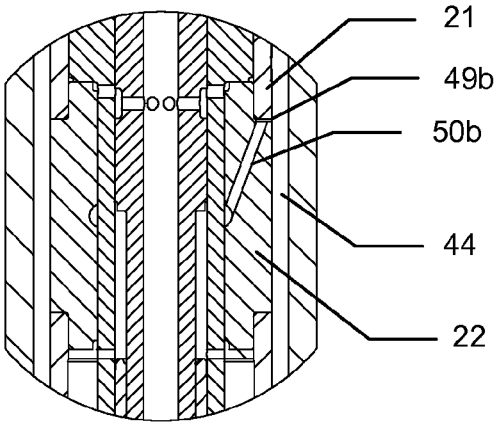
Figure 6:
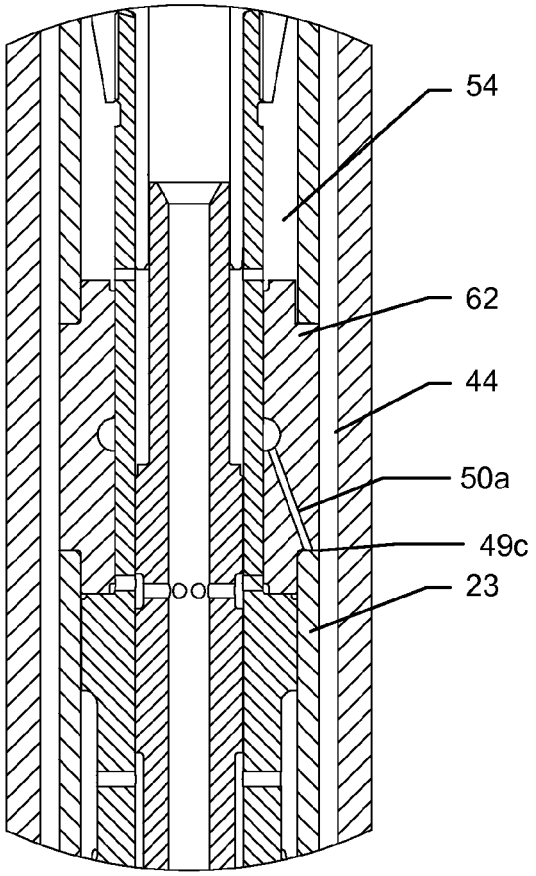

FIGS. 2A, 2B, and 2C are partial cross sectional views of the hydraulic pulse valve, respectively showing a piston used in the valve going down and a pilot of the valve in an upper position (also illustrating an enlarged portion of the figure), a view of the piston down and the pilot in an upper position, and a view of the piston down with the pilot going down;

FIG. 3 is an isometric view of an exemplary split ring seal used in the valve;

FIG. 4 is an isometric view of an exemplary split ring seal assembly;

FIG. 5A is a cross-sectional view of another exemplary embodiment of the hydraulic pulse valve, illustrating a slit configuration disposed at a lower stop ring;

FIG. 5B is a cross-sectional view of another exemplary embodiment of the hydraulic pulse valve, illustrating a different slit configuration formed at the lower stop ring; and FIG. 6 is a cross-sectional view of still another exemplary embodiment of the hydraulic pulse valve, illustrating a slit configuration in relation to an upper stop ring that is formed as a single or integral component.

DESCRIPTION

Figures and Disclosed Embodiments are not Limiting

Exemplary embodiments are illustrated in referenced Figures of the drawings. It is intended that the embodiments and Figures disclosed herein are to be considered illustrative rather than restrictive. No limitation on the scope of the technology and of the claims that follow is to be imputed to the examples shown in the drawings and discussed herein. Further, it should be understood that any feature of one embodiment disclosed herein can be combined with one or more features of any other embodiment that is disclosed, unless otherwise indicated.

The operation and configuration of a poppet valve and pilot shift mechanism in a hydraulic pulse valve are described in applicant's commonly assigned U.S. patent application Ser. No. 12/957,049, which was filed on Nov. 30, 2010. The present application describes the design of an upper stop ring assembly to control the fluid flow that causes the pilot valve to shift between open and closed states, when generating pressure pulses.

Figure 1A:
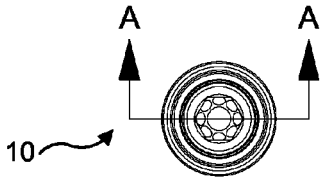
FIG. 1A is a top plan view of an exemplary embodiment of a hydraulic pulse valve that includes a novel split ring shift control, in accord with the following description.
Figure 1B:
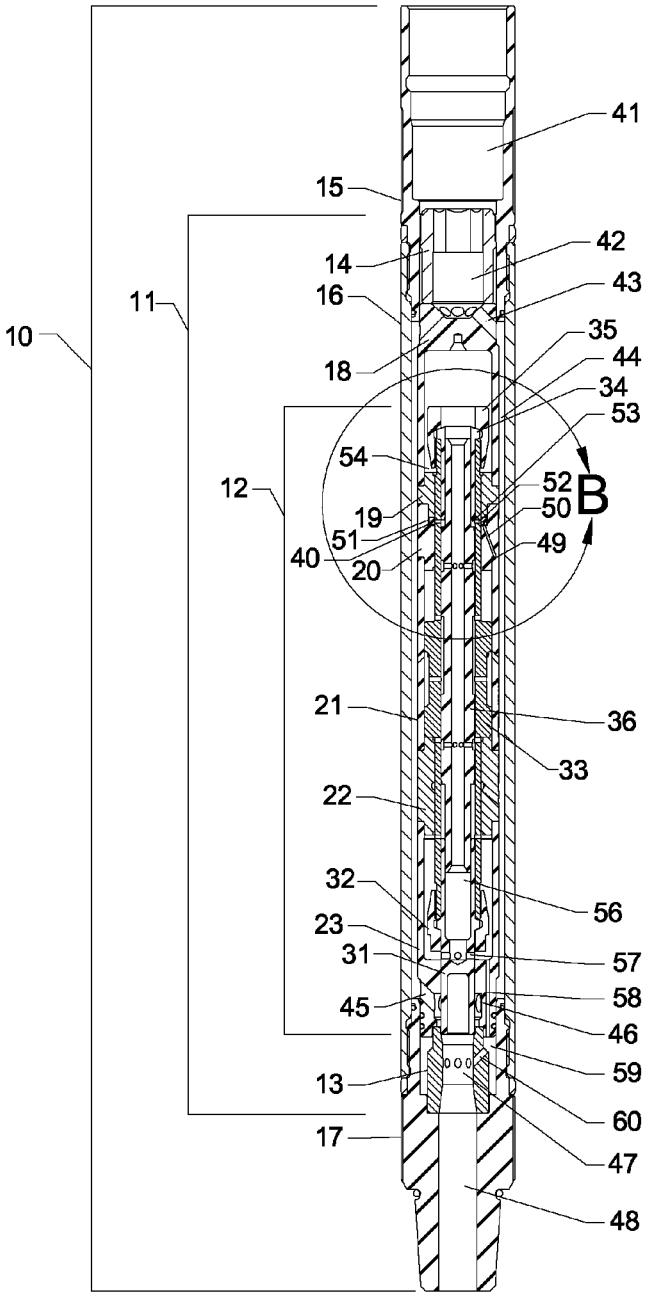
FIG. 1B is cross-sectional view of the hydraulic pulse valve, taken along section line A-A of FIG. 1A.

FIG. 1A shows a top plan view of the hydraulic pulse valve in which the upper stop ring assembly is included, and FIG. 1B shows a cross section of the hydraulic pulse valve, as taken along a section line A-A of FIG. 1A. Referring to FIG. 1B, a poppet assembly 12 is disposed inside a spool assembly 11. Spool assembly 11 is in turn, disposed inside a housing assembly 10. The housing assembly includes an upper adaptor 15, a housing 16, and a lower adaptor 17. Upper adaptor 15 includes inlet threads and seals to connect a fluid passage 41 to a supply tube, and lower adaptor 17 incorporates threads and seals and a fluid passage 48 for fluid connection to downstream components of a bottom hole assembly, such as a motor and mill, or a jetting head.

Poppet assembly 12 comprises a piston 33 with a poppet 31 attached at its distal end by a nut 32, and a pilot bushing 34 attached at its proximal end with a nut 35. The poppet assembly moves up and down inside spool assembly 11. The spool assembly includes a poppet seat 13, a lower manifold 23, a lower stop ring 22, a sleeve 21, a female upper stop ring 20, a male upper stop ring 19, and an upper manifold 18. Female upper stop ring 20 limits the upward travel of piston 33, and lower stop ring 22 limits its downward travel within spool assembly 11. A clamp ring 14 is threadably engaged with upper adaptor 15 to securely clamp the components of the spool assembly inside the housing.

A pilot 36 slides inside poppet assembly 12, between an upper position and a lower position. In FIG. 1B, the pilot is shown in its upper position, and the poppet assembly is shown in its lower position, with poppet 31 engaged with poppet seat 13 to block fluid flow through the tool. When the valve is opened as poppet 31 moves out of engagement with poppet seat 13, fluid moves from inlet passage 41 through fluid passages 42, 43, 44, 45, 46, and 47 to an outlet passage 48.

FIGS. 2A, 2B, and 2C show a detail of the seal area, with the poppet and pilot in various positions, as the poppet closes and the pilot shifts. Detail area B of FIG. 1B, which illustrates the split ring seal area, is shown in FIG. 2A, 2B, and 2C, respectively, as detail B-1, B-2, and B-3. Detail B-1 in FIG. 2A shows piston 33 moving downwardly, with pilot 36 in its upper position. Fluid passage 44 is at a relatively high pressure and is in fluid communication through a slit 49 and a passage 50, with a cavity 51 that contains a split ring 40. This split ring is split at reference letter 61, as shown in FIG. 3, so that it can be sprung open and is thus elastomerically biased to form an interference fit around the outer surface of piston 33. An outer diameter and a distal side of split ring 40 are pressurized by the fluid in cavity 51, forcing its proximal side to form a seal against an adjacent surface of male upper stop ring 19 and forcing the internal diameter of the split ring to seal against the outer surface of piston 33. As shown in FIG. 1B, the proximal side of male upper stop ring 19 forms a distal surface of a cavity 54, which is at a relatively low pressure, because cavity 54 is in fluid communication through passages 55, 56, 57, 58, 59, and 60, with a poppet seat discharge passage 47. Those skilled in the art will recognize that any leakage flow from the distal to the proximal sides of split ring 40 will cause a pressure gradient between the distal and proximal surfaces of the split ring, so that the average pressure in the internal diameter of the seal is always lower than the pressure on the outer diameter of the seal, and the inner diameter is thus forced into contact with the piston, forming an effective sliding seal around the outer surface of piston 33.

Split ring 40 is preferably manufactured from a hard, non-abrasive material such as hard steel or coated with hard material or hardened to prevent wear and to reduce friction between the split ring and the surface of piston 33. The cross-sectional geometry of the split ring may also be varied to improve wear and reduce friction. In particular, the width of the outside surface of the ring and the width of the surface at the inside diameter may be varied to reduce contact pressure. Split ring 40 is provided to prevent pressurized fluid from cavity 51 leaking up though an annular clearance between piston 33 and male upper stop ring 19, through flow passage 52, and into cavity 53. In the absence of the sealing action of split ring 40, the leakage flow of fluid though the annular clearance would pressurize cavity 53, which would cause pilot 36 to start to shift position within piston 33 before the poppet attached to piston 33 is closed and would cause the poppet to open too quickly.

FIG. 2B shows the pilot and piston configuration when piston 36 is down and poppet 31 is seated on poppet seat 13. At this point in the operation of the valve, flow passage 52 is moving past split ring 40 toward the configuration shown in FIG. 2C. As shown in FIG. 2C, the flow of pressurized fluid is then directed to cavity 53 to cause the pilot to start to shift downwardly (as shown in the orientation of this Figure).

As shown in detail C of FIG. 2A, the flow rate of pressurized fluid into cavity 53 (after flow passage 52 has moved past the seal of split ring 40) is limited by the flow restriction provided by slit 49 between female upper stop ring 20 and sleeve 21. As shown in FIG. 4, the flow restriction formed by the intersection of passage 50 and slit 49 can be precisely controlled in order to limit the rate at which the pilot shifts. Slit 49 can be formed by grinding a small area from a portion of a distal surface of female upper stop ring 20 that is adjacent to the proximal end of sleeve 21, as shown in FIG. 4. A smaller flow restriction reduces the pilot shift speed and causes the poppet to stay closed longer. The slit opening (i.e., a spacing between the distal surface of female upper stop ring 20 that is ground away and proximal end of sleeve 21) is smaller than the diameter of flow passage 50, so that any particles small enough to enter the slit will not plug flow passage 50. The slit opening to flow passage 44 is relatively wide and narrow so that the slit acts as a shear screen that excludes large particles.

Other configurations of the slit opening are possible. For example, the slit may be formed by grinding the proximal end of sleeve 21 instead of the distal surface of female upper stop ring 20.

A similar slit and orifice combination can be incorporated into lower stop ring 22 in order to filter particles that enter though this port from the fluid used to actuate the pilot. As shown in FIG. 5A, the lower stop ring includes a fluid port 50*a* that is in fluid communication with a slit 49*a*, which controls fluid flow into fluid port 50*a* and filters out particulate matter that would otherwise enter fluid port 50*a*. Slit 49*a* is can be formed by grinding or otherwise removing a portion of the contact area between the distal surface of lower stop ring 22 and the proximal surface of manifold 23.

As shown in a further alternative exemplary embodiment of FIG. 5B, a fluid port 50*b* can be provided in fluid communication with slit 49*b*, which is formed on a portion of the contact surface between sleeve 21 and the proximal surface of lower stop ring 22. Slit 49*b* controls fluid flow into fluid port 50*b* and serves to filter out particulate matter that would otherwise enter the fluid port. An example of how a portion of one or both of these surfaces may be ground to form a slit, such as slit 49*b*, is shown in FIG. 4. It will further be understood that multiple passages and slits can be provided to increase the available fluid flow area through the lower stop ring and thereby increase the rate of fluid flow. Also, the lower stop ring can be configured with a split ring (not shown), like split ring 40, to provide additional fluid flow control in a manner similar to the upper stop ring assembly described above.

Furthermore, as shown in FIG. 6, the upper stop ring assembly can fabricated as a single or integral upper stop ring 62 (i.e., without using male and female upper stop ring components), with a slit 49*c* formed between in the contact area of the distal end of upper stop ring 62 and the proximal surface of manifold 23.

Although the concepts disclosed herein have been described in connection with the preferred form of practicing them and modifications thereto, those of ordinary skill in the art will understand that many other modifications can be made thereto within the scope of the claims that follow. Accordingly, it is not intended that the scope of these concepts in any way be limited by the above description, but instead be determined entirely by reference to the claims that follow.

What is claimed is:

1. A hydraulic pulse valve for generating pressure pulses in a conduit in which the hydraulic pulse valve is disposed, comprising:

(a) an elongate housing in which is disposed a valve assembly, the valve assembly including:

(i) a poppet that is reciprocally movable between a closed position in which it at least partially blocks a pressurized fluid from flowing through a throat of a poppet seat in the valve assembly, and an open position in which the pressurized fluid flows through the throat of the poppet seat, a reciprocating motion of the poppet between the closed position and the open position generating the pressure pulses in the conduit; and (ii) a pilot that is disposed within the poppet and reciprocates between disparate first and second positions to periodically alter fluid communication paths within the valve assembly, alteration of the fluid communication paths causing the poppet to reciprocate between the closed position and the open position; and (b) a sliding seal that controls leakage of a pressurized fluid through the valve assembly, the sliding seal comprising a split ring that is actuated by a pressure differential between an inner surface and an outer surface of the split ring.

2. The hydraulic valve of claim 1, wherein the split ring limits leakage of the pressurized fluid into a cavity defined at least in part by the pilot, so that as the pilot moves between the first and second positions relative to the split ring, the cavity passes the split ring, and the split ring then no longer limits leakage of the pressurized fluid into the cavity.

3. The hydraulic pulse valve of claim 1, wherein the valve assembly further comprises a spool housing in which the poppet and the pilot are disposed.

4. The hydraulic pulse valve of claim 3, wherein the spool housing comprises a stack of components that are clamped together.

5. The hydraulic pulse valve of claim 1, further including a flow restriction comprising a slit intersecting a flow passage disposed within the valve assembly and limiting a rate at which the pressurized fluid flows through the valve assembly to actuate the pilot to shift between the first and second positions.

6. The hydraulic pulse valve of claim 5, wherein an opening defined by the slit is smaller in dimension than a diameter of the flow passage intersected by the slit, so that particulate matter that is small enough to pass through the slit will not plug the flow passage to prevent the pressurized fluid from flowing through the flow passage.

7. The hydraulic pulse valve of claim 5, wherein the slit is formed between a stop ring and a sleeve disposed around the piston.

8. The hydraulic pulse valve of claim 5, wherein the flow passage intersected by the slit conveys the pressurized fluid to a cavity in which the sliding seal is disposed.

9. The hydraulic pulse valve of claim 5, wherein the slit is defined in part by a surface of a lower stop ring and filters particulates from the pressurized fluid used to actuate the pilot.

10. The hydraulic pulse valve of claim 5, wherein the slit is defined by a flat recess on a first component that is disposed adjacent to a flat surface on a second component.

11. The hydraulic pulse valve of claim 1, wherein the sliding seal is formed from a hardened material that is non-abrasive.

12. The hydraulic pulse valve of claim 1, where the sliding seal varies in at least one of a width of an outside surface, and a width of an inner surface.

13. A method for generating pressure pulses in a conduit, comprising:

(a) supplying a pressurized fluid through the conduit to a valve assembly;

(b) periodically interrupting a flow of the pressurized fluid with a reciprocating poppet disposed in the valve assembly that is actuated as a result of periodic changes in a fluid path along which the pressurized fluid flows through the valve assembly, the poppet periodically moving between a closed position that substantially blocks the flow of the pressurized fluid through the valve assembly and an open position in which the pressurized fluid flows through the valve assembly;

(c) using a sliding seal for controlling a leakage of the pressurized fluid within the valve assembly, to prevent the poppet from prematurely moving from the closed position to the open position and thereby increasing a time during which the poppet substantially interrupts the flow of pressurized fluid through the valve assembly when generating the pressure pulses;

(d) where the sliding seal comprises a split ring; and (e) exposing the split ring to a differential fluid pressure between an inner surface of the split ring and an outer surface of the split ring, wherein a greater fluid pressure applied to the outer surface relative to the inner surface biases the split ring into sealing contact with a moving member of the valve assembly.

14. The method of claim 13, wherein the sliding seal controls leakage of the pressurized fluid into a cavity of the valve assembly for a portion of the time that the poppet is in the closed position, further comprising enabling the pressurized fluid to flow past the sliding seal and into the cavity of the valve assembly as the cavity moves past the sliding seal, so that the pressurized fluid flowing into the cavity can then cause the poppet to move from the closed position to the open position.

15. The method of claim 14, wherein the pressurized fluid is conveyed to the sliding seal through a flow passage, further comprising limiting a rate of flow of the pressurized fluid into the flow passage by intersecting the flow passage with a slit through which the pressurized fluid must flow to reach the flow passage.

16. The method of claim 15, wherein a dimension of the slit is less than a cross-sectional size of the flow passage, further comprising using the slit to filter particulate matter from the pressurized fluid before the particulate matter reaches the flow passage, so that the particulate matter does not plug the flow passage.

17. The method of claim 14, comprising forming the slit between an upper stop ring and a sleeve that is disposed around a moving member of the valve assembly.

18. The method of claim 14, comprising forming the slit between a lower stop ring and a fluid passage of the valve assembly, to filter particulate matter that would otherwise enter a port of the fluid passage.

19. The method of claim 13, further comprising forming the sliding seal from a hardened material that is non-abrasive to prevent wear and reduce friction with an adjacent surface of a moving component of the valve assembly.

20. The method of claim 13, further comprising varying at least one of a width of an outside surface, and a width of an inner surface of the sliding seal to improve wear and reduce friction between the sliding seal and a surface of a moving element around which the sliding seal is disposed.

* * * * *